US005706525A

United States Patent [19]

Olivier

[11] Patent Number: 5,706,525

[45] Date of Patent: Jan. 13, 1998

[54] TOILET SEAT

[75] Inventor: Gerard Joseph Cecil Olivier, North Fremantle, Australia

[73] Assignee: Colivier Pty Ltd, North Fremantle, Australia

[21] Appl. No.: 612,972

[22] PCT Filed: Sep. 9, 1994

[86] PCT No.: PCT/AU94/00537

§ 371 Date: Mar. 6, 1996

§ 102(e) Date: Mar. 6, 1996

[87] PCT Pub. No.: WO95/08030

PCT Pub. Date: Mar. 23, 1995

[30] Foreign Application Priority Data

Sep. 13, 1993 [AU] Australia ..... PM1219
Nov. 30, 1993 [AU] Australia ..... PM2757

[51] Int. Cl.[6] ..... A47K 3/20
[52] U.S. Cl. ..... 4/420.4
[58] Field of Search ..... 4/420.1, 420.2, 4/420.4, 447

[56] References Cited

U.S. PATENT DOCUMENTS

| | | | |
|---|---|---|---|
| 2,875,450 | 3/1959 | Umann . | |
| 3,605,124 | 9/1971 | Marcard . | |
| 4,197,594 | 4/1980 | Butterfield . | |
| 4,334,329 | 6/1982 | Miyanaga . | |
| 4,570,274 | 2/1986 | Kaneko . | |
| 5,359,736 | 11/1994 | Olivier | 4/420.2 X |

FOREIGN PATENT DOCUMENTS

| | | | |
|---|---|---|---|
| 0 051 982 | 5/1982 | European Pat. Off. . | |
| 725011 | 5/1932 | France . | |
| 5255963 | 10/1993 | Japan | 4/420.2 |
| 342717 | 2/1931 | United Kingdom . | |

OTHER PUBLICATIONS

Translation of Republic of China Publication No. 103201.
Translation of Republic of Chiina Publication No. 165486.
Translation of Republic of China Publication No. 220087.

*Primary Examiner*—Charles E. Phillips
*Attorney, Agent, or Firm*—Merchant, Gould, Smith, Edell, Welter & Schmidt, P.A.

[57] ABSTRACT

A toilet seat adapted to be fixed to a toilet bowl the seat accommodating a conduit adapted to be connected to a water supply, the conduit being connected to an outlet nozzle which is supported from an arm supported from the seat such that the nozzle is to be located within the toilet bowl and is directed upwardly, the nozzle being movable along a path within the toilet bowl which is substantially coincidental with a fore and aft axis of the toilet bowl and being movable from a first position adjacent the wall of the toilet bowl to a second position where the nozzle lies in the path, a drive mechanism to cause movement of the arm, the seat accommodating an air duct adapted to be connected to a forced air supply, the air duct having an outlet at the front and rear of the toilet seat, the outlets being positioned to direct air to the posterior and anterior region of the occupant's body encompassed by the toilet seat, a control mechanism controlling the delivery of water the delivery of air and the operation of the drive mechanism, the arm being moved to cause the nozzle to move along the path to one or more locations, at which locations the arm is caused to move the nozzle through a small range of movements along the path, the control mechanism causing the delivery of water to the nozzle and subsequently the control mechanism further causing the delivery of air to the duct.

14 Claims, 8 Drawing Sheets

TOILET SEAT

THIS INVENTION relates to a device which can be used in association with a toilet and which can serve the functions of a bidet.

The invention of the present application relates to an earlier invention disclosed in International Patent Application Number PCT/AU91/00523

Throughout the specification the term toilet bowl shall be taken to include a toilet bowl of substantially conventional form which defines a pan and which is capable of receiving a toilet seat.

In one form the invention resides in a toilet seat adapted to be fixed to a toilet bowl to be movable between a seating position overlying the toilet bowl and a raised position, said seat accommodating a conduit adapted to be connected to a water supply, said conduit being connected to an outlet nozzle which is supported from an arm supported from the seat such that the nozzle is to be located within the toilet bowl and is directed upwardly, the arm being supported from the toilet seat to be movable to cause the nozzle to be movable along a path within the toilet bowl which is substantially coincidental with a fore and aft axis of the toilet bowl the arm also being supported from the toilet seat to cause the nozzle to be movable from a first position adjacent the wall of the toilet bowl to a second position where the nozzle lies in the path, drive means to cause said movement of the arm, said seat accommodating an air duct adapted to be connected to a forced air supply, said air duct having an outlet at the front and rear of the toilet seat, said outlets being positioned to direct air to the posterior and anterior region of the occupant's body encompassed by the toilet seat, a control means controlling the delivery of water, the delivery of air and the operation of the drive means, said arm being movable on activation by the drive means from the first position to the second position, said arm being then moved to cause the nozzle to move along the path to at least one location at which locations the arm is caused to move the nozzle through a small range of movement along the path at each location, the control means causing the delivery of water to the nozzle and at said positions, the control means further causing the delivery of air to the duct subsequent to the delivery of water to the nozzle.

According to a preferred feature of the invention the toilet seat is provided with a water reservoir and said conduit is connected to the reservoir. It is preferred that the reservoir be provided with a heater and that it have a vertical dimension greater than its horizontal aspect to facilitate stratification. The water reservoir is connected to a main water supply.

According to a further preferred feature the toilet seat accommodates the forced air supply which comprises a fan. It is preferred that a separate duct and if preferred a separate forced air delivery means be associated with each outlet. According to a further preferred feature each outlet is associated with a closure operated from the control means whereby the closure will open on activation of the forced air supply.

The invention will be more fully understood in the light of the following description of two specific embodiments. The description is made with reference to the accompanying drawings of which:

Figure 1:
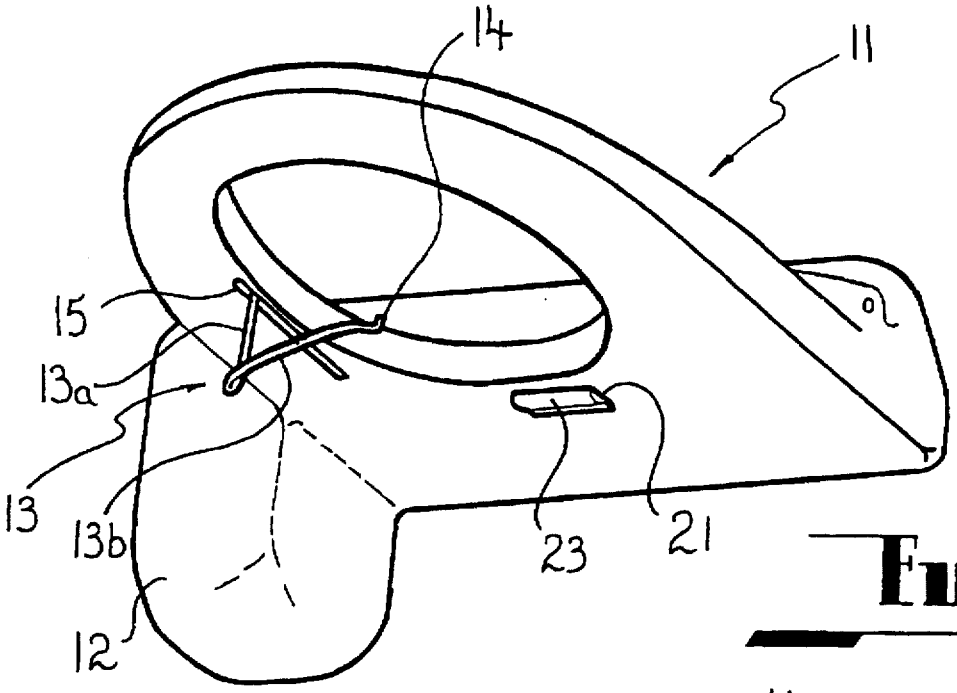
FIG. 1 is an underneath isometric view of the first embodiment showing the nozzle in its second position.

The first embodiment as shown at FIGS. 1, 2, 3, 4 and 9 comprises a toilet seat of substantially conventional configuration which has an annular body 11 and which is adapted to be fixed to a toilet bowl (not shown) in the conventional manner where it is pivotally supported to be movable from a seating position overlying the toilet bowl to a raised position.

The rear portion of the toilet seat is formed to provide a housing 12 for a water reservoir (not shown). The water reservoir is provided with an electrically powered immersion heater element which is thermostatically controlled and is provided with an inlet which is capable of being connected to a mains water supply through a secondary reservoir which is also provided with a pump to deliver water to the water reservoir. The water reservoir has the form of an upright cylinder to enhance stratification.

The water reservoir is connected to an arm 13 by means of a flexible conduit (not shown) and the outer end 14 of the arm supports a spray nozzle. The arm 13 is supported from the underneath of one side of the toilet seat by a drive mechanism such that it is movable longitudinally along the toilet seat. Such longitudinal movement is accommodated for by means of an elongate slot 15 in the underneath of the toilet seat and the movement is effected from an electric motor through a suitable drive whereby the arm is movable for the substantially full length of the slot 15. In addition the mechanical drive provides a drive to the arm to enable it to rotate about a vertical axis at its forwardmost position in the slot 15. The arm 13 comprises a vertical portion 13*a*which extends downwardly from the underneath of the toilet seat and which terminates with a lateral portion 13*b*which extends to one side of the vertical portion 13*a*and which terminates at the free end 14.

Figure 12:
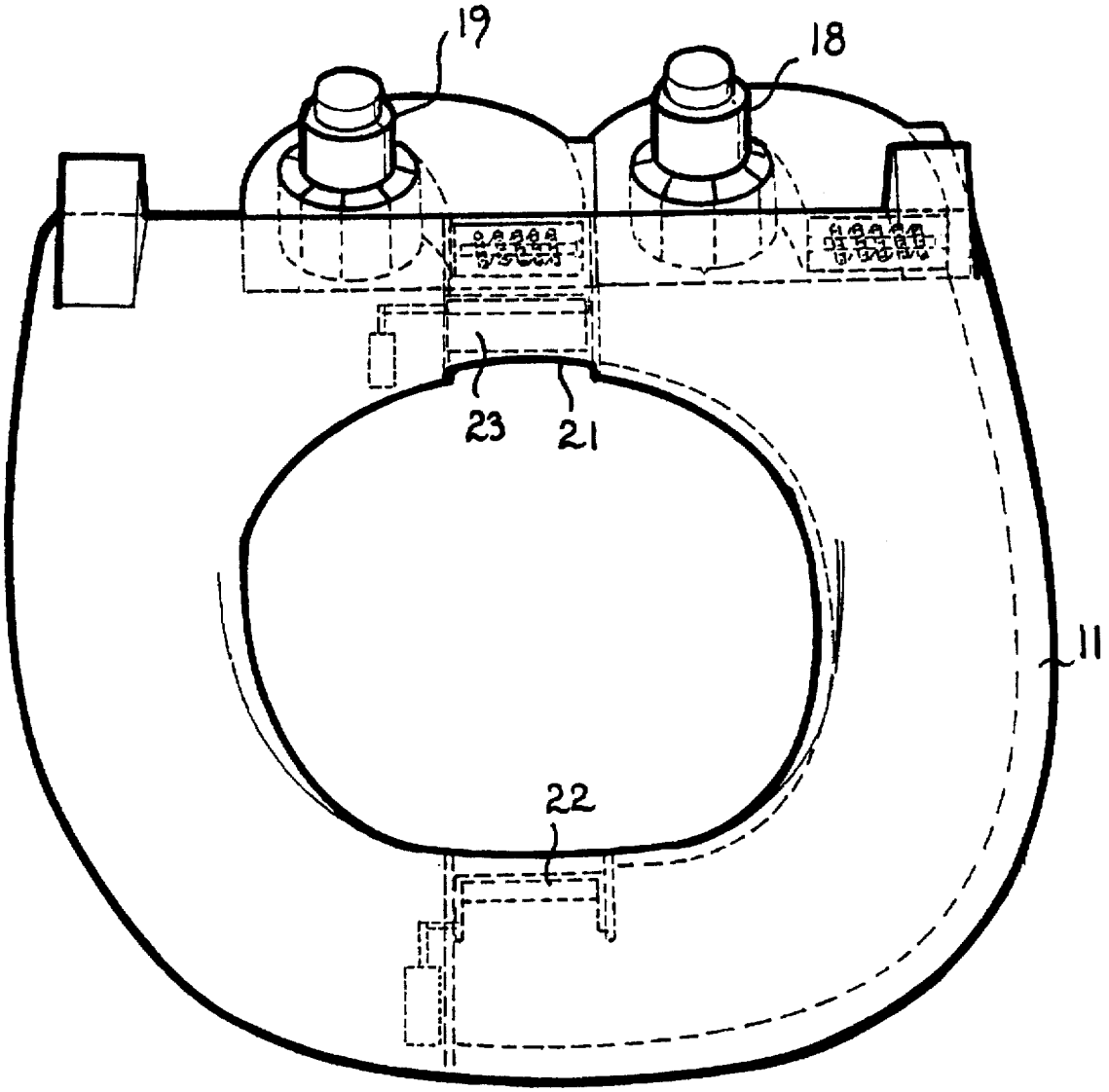
FIG. 12 is a plan view of the toilet seat of the first embodiment illustrating the arrangement of the air ducts.

In addition the toilet seat is formed with a pair of ducts 16 and 17 (see FIGS. 3 and 12) which are each connected to an air inlet through an electrically driven fan 18 and 19 respectively. One air duct 16 extends from the rear portion of the toilet seat to a front outlet 20 at the inner rim of the toilet seat towards the forward side thereof while the second duct 17 is connected to a rear outlet 21 provided in the under surface of the toilet seat adjacent the inner rim at the rear side of the toilet seat. Each fan is associated with a heating element which heats the air being delivered to the respective duct. The heating elements are activated on activation of the respective fan.

Each outlet 20 and 21 is associated with a shutter like closure 22 and 23 which are operated through a suitable control mechanism to be capable of selectively opening the respective outlet 20 and 21.

The toilet seat further accommodates a control means which is capable of controlling the delivery of water from the reservoir to the outlet nozzle 14, the operation of the fans 18 and 19 to deliver air to the respective outlets 20 and 21, the operation of the respective closures 22 and 23 of each outlet 20 and 21 and the movement of the arm 13.

Figure 2:
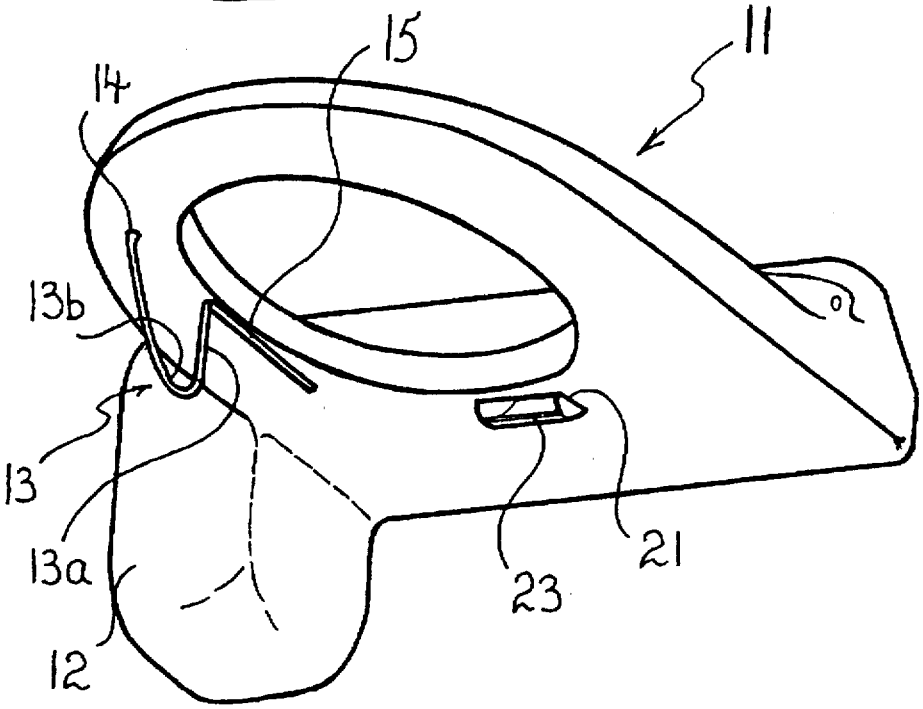
FIG. 2 is an underneath isometric view of the first embodiment showing the nozzle in its first position.
Figure 4:
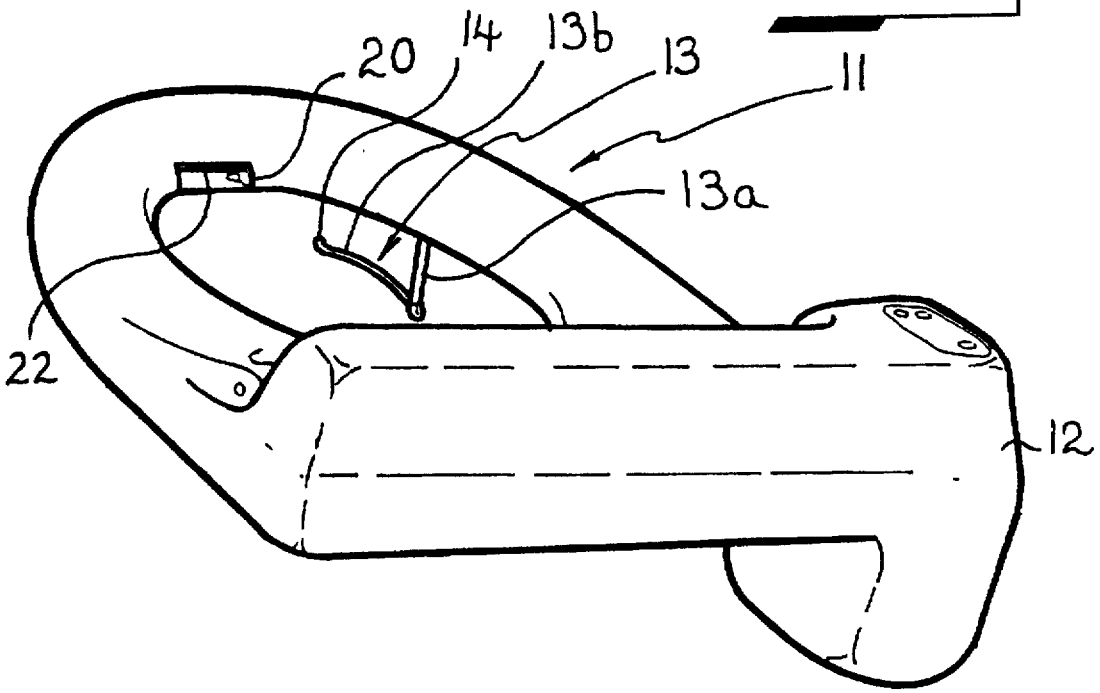
FIG. 4 is an upper isometric view of the first embodiment with the arm in the first position.
Figure 5:
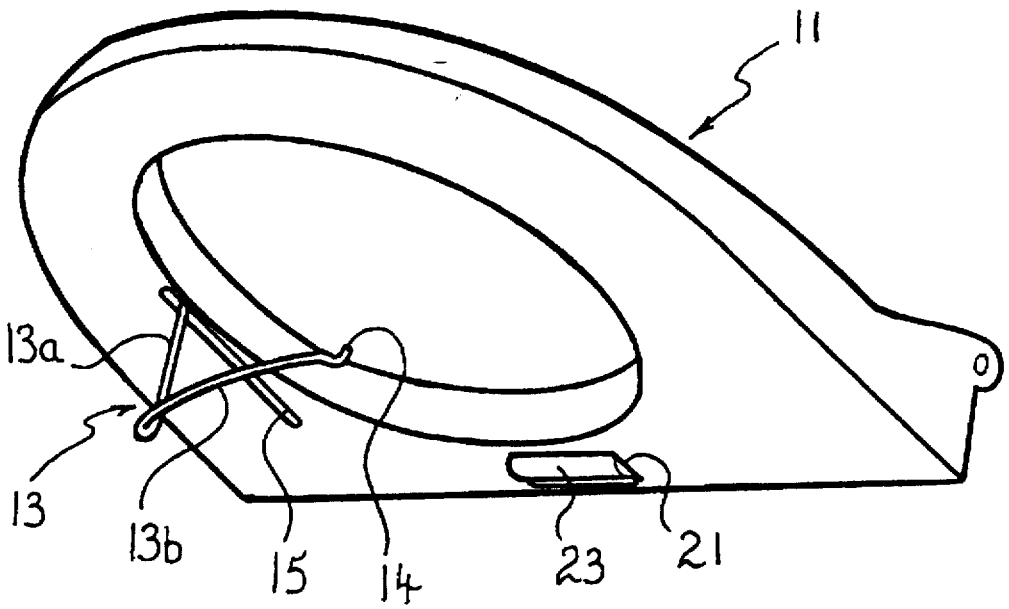
FIGS. 5 & 6 are each an underneath isometric view of the second embodiment with the arm in its second and first position respectively.
Figure 6:
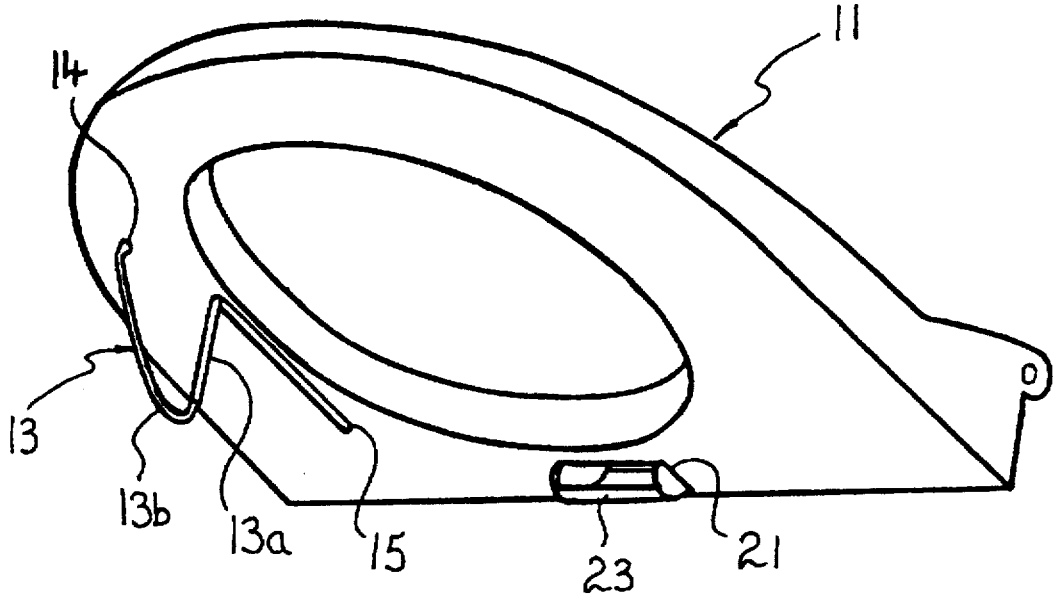
Figure 7:
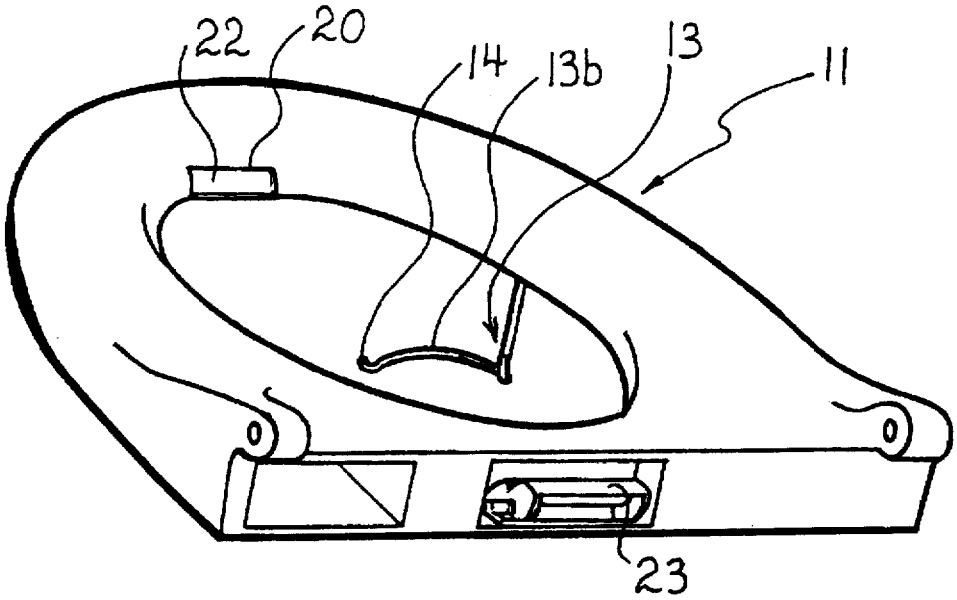
FIGS. 7 & 8 are each an upper isometric view of the second embodiment with the arm in the second and first position respectively.
Figure 8:
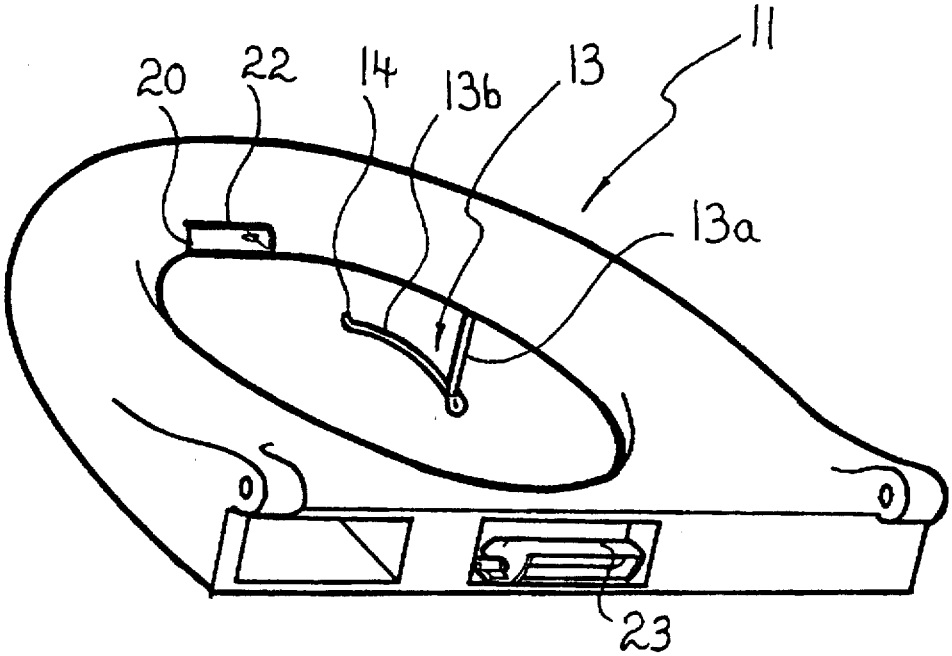

When not required the arm occupies a first position (as shown at FIG. 2) at which it lies adjacent the wall of the toilet bowl below the inner flange which is normally provided in the toilet bowl to provide for the delivery and distribution of water to the toilet bowl as shown at FIGS. 2 and 4.

Figure 3:
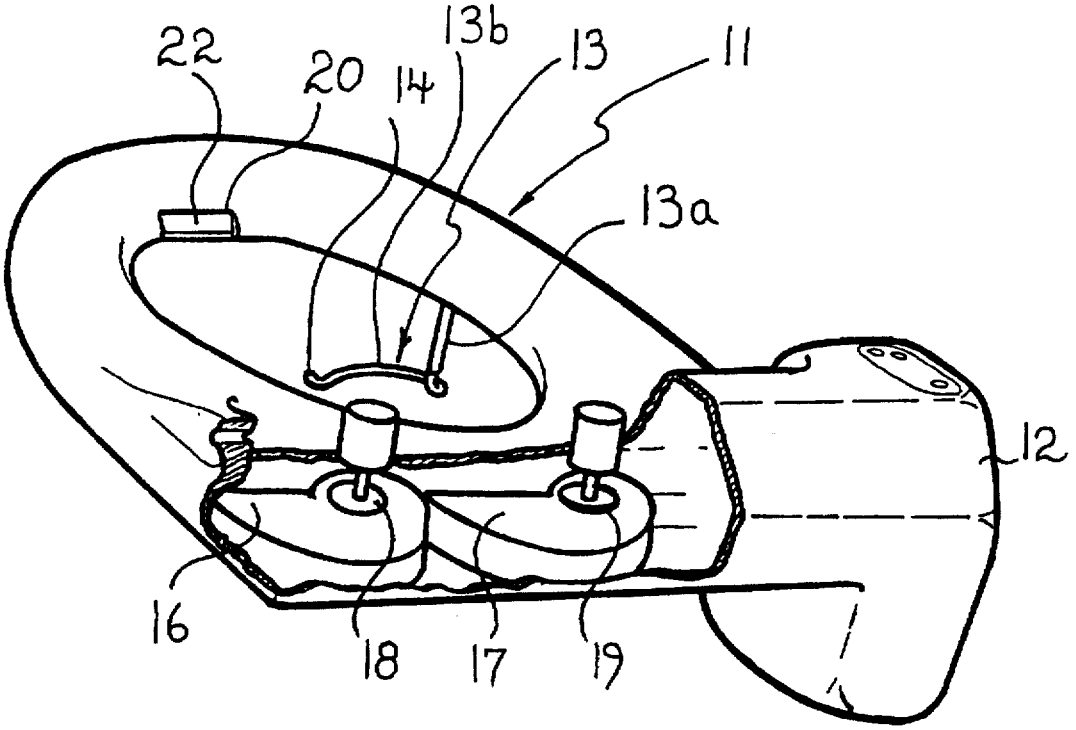
FIG. 3 is an upper isometric part cut-away view of the first embodiment with the arm in the first position.

The control means is provided with a selective switching means which is able to activate the device according to the requirements of a male or female occupant of the toilet seat. In the case of an occupant being a female, a further selective is available depending on the working operation (ie. washing of the anus or genitalia). In the event that the control means is activated to indicate the presence of a female occupant the arm is moved from its first position to a second position as shown in FIGS. 1 and 3 where the nozzle lies in the central portion of the toilet bowl below the posterior of the occupant and lies along the substantially central fore-aft axis of the toilet bowl. Having been moved to that second position the arm is then caused to be moved to a rearmost position corresponding substantially below the anticipated position of the anus of the occupant and/or an intermediate position substantially below the anticipated portion of the genitalia of the occupant. When at the rearmost position the arm is then caused to be moved along a limited range of movements along the central fore-aft axis to reciprocate the nozzle along the path. While undergoing this movement water is delivered from the reservoir to the spray nozzle provided at the outer end 14 of the arm in order to wash the anus. Having executed at least one limited movement the water is then shut off and the arm moves to an intermediate position at which the nozzle 14 substantially underlies the genitalia of the occupant. At this position the arm again is caused to be moved along a limited range of movements along the central fore-aft axis to reciprocate the nozzle along the path below the genitalia of the occupant. While undergoing this movement water is delivered to the spray nozzle from the reservoir. On the completion of at least one limited movement of the arm the water is shut off and the arm is then caused to return to its first position. When the arm has been returned to its first position the fans 18 and 19 are then selectively activated and the closures 22 and 23 are activated to enable the delivery of warm air from one or both of the outlets 20 and 21 provided at the forward and rear sides of the toilet seat to facilitate the drying of the wetted regions of the occupant.

In the event that the occupant activates the switch to indicate the presence of a male occupant the arm undergoes a similar movement to that described above with the exception that it will only move to the rearmost position and air is delivered from the rear duct only. In all other respects the movement of the arm, activation of the water delivery to the nozzle, and the activation of the fans and the shutters is the same.

A position sensor is associated with the toilet seat whereby on the toilet seat being raised from the toilet bowl the drive is instantly activated to move the arm from its first position to the second position to enable the toilet seat to be fully raised from the toilet bowl. If desired this may comprise or be associated with a latching mechanism which positively retains the toilet seat in position and whereby activation of the latch causes movement of the arm from its first position.

A further feature of the toilet seat may incorporate the presence of an electric heating element in the body of the toilet seat whereby the body of the toilet seat may be heated to facilitate the comfort of the occupant of the toilet seat.

In an alternative form of the first embodiment the water reservoir and air delivery fans may be provided separate from the body of the toilet seat.

The second embodiment shown at FIGS. 5, 6, 7 and 8 is of a substantially corresponding form to that of the first embodiment except that the water reservoir and air delivery fans are provided separate from the toilet seat.

Figure 9:
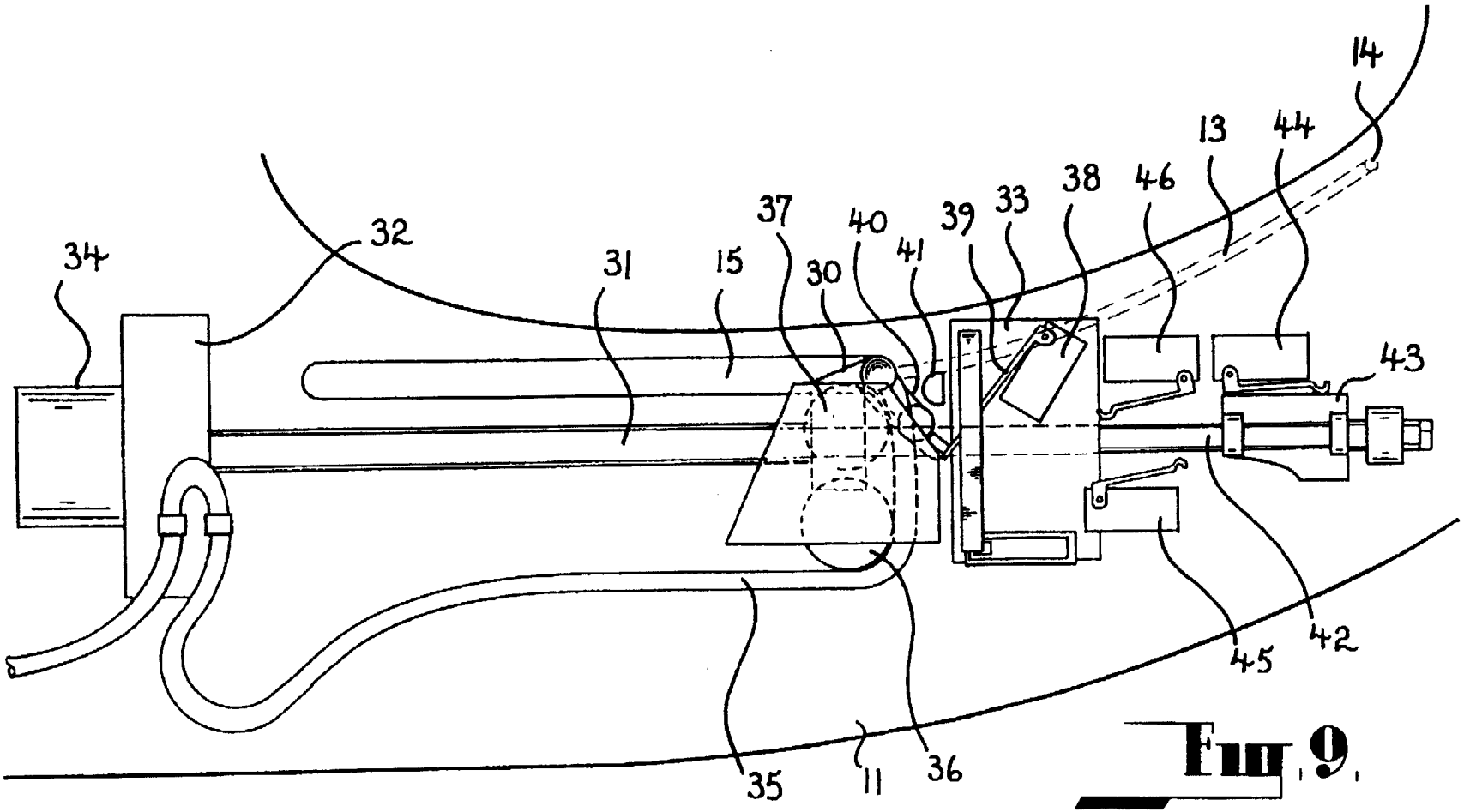
FIG. 9 is a part sectional plan view of a seat according to both embodiments illustrating the drive for the arm with the arm in its first position.
Figure 10:
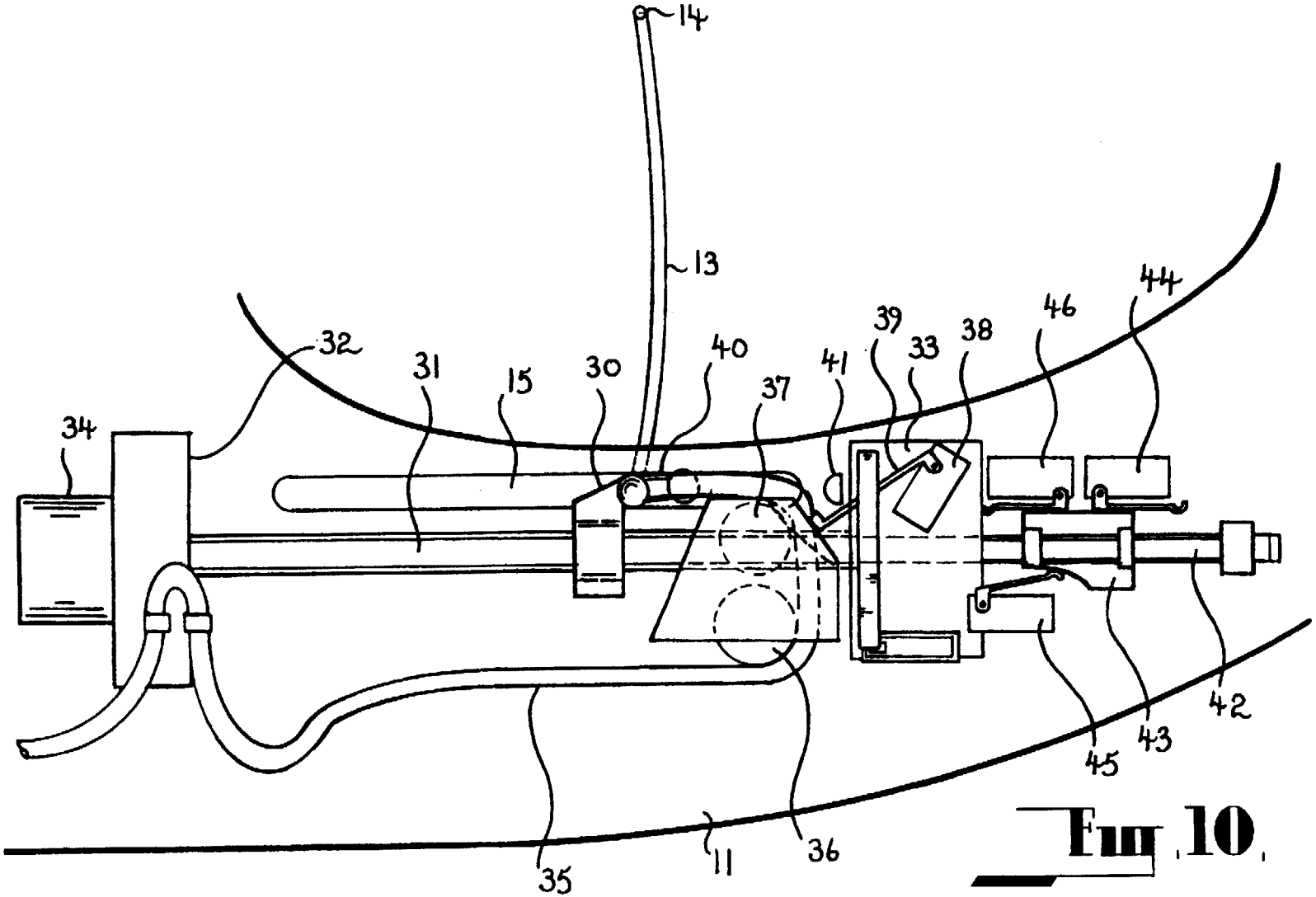
FIG. 10 is a view similar to FIG. 9 with the arm in its second position towards its forwardmost end of its second position.
Figure 11:
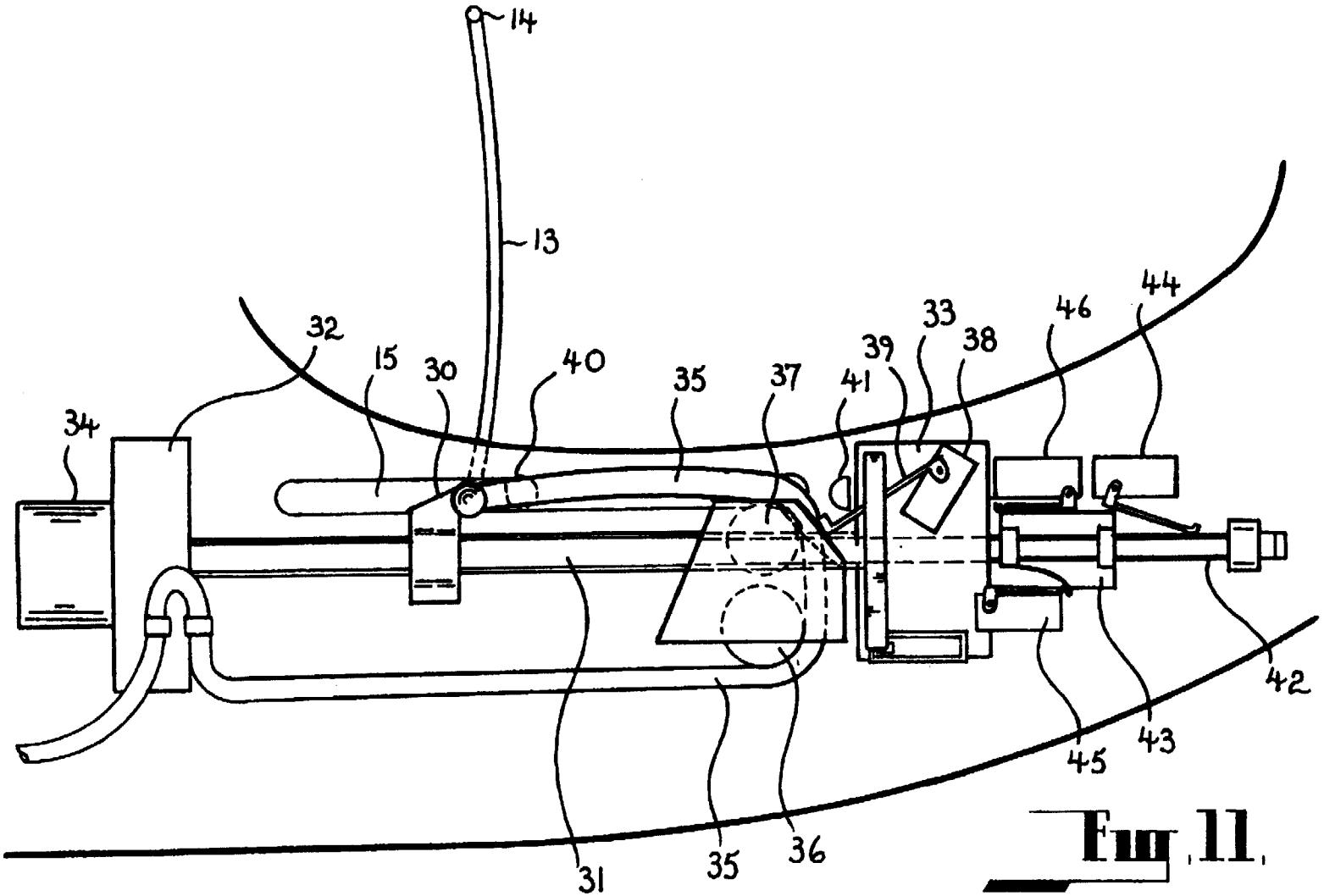
FIG. 11 is a view similar to FIGS. 9 and 10 with the arm in its second position towards its rearmost end of its second position.

FIGS. 9, 10 and 11 illustrate the drive mechanism for the arm 13 of both of the embodiments.

The arm 13 is supported at its upper end within the body of the toilet seat from a carrier 30 which is threadably received on a threaded shaft 31 supported between a first and second bearing housing 32 and 33. The first bearing housing supports a drive motor 34 which has its drive shaft fixed to the threaded shaft 31 whereby activation of the motor causes rotation of the threaded shaft 31.

The upper end of the arm 13 is connected to a flexible conduit 35 which passes around a pair of pulley-like supports 36 and 37 adjacent the second bearing housing 33 to support the conduit during its movement as a result of the movement of the arm 13 along the slot 15 and in order to prevent kinking of the conduit 35 during such movement.

The second bearing housing 33 supports a primary switch 38 which has an activation arm 39. The arm 13 is intended to engage the activation arm 39 of the primary switch 38 when the arm 13 is at its first position. To move the arm 13 from its first position as shown at FIG. 9 to the second position, the upper end of the arm is formed with a radial extension 40 and the second bearing housing incorporates a cam element 41. The radial extension 40 is engaged with the cam element 41 to cause the arm 13 to pivot about its vertical axis whereby the arm can move between its first and second positions. As the carrier 30 moves towards the second bearing housing 33 along the slot 15 the radial extension 40 engages with the cam element 41 to pivot the arm to move from its second position. As the carrier 30 moves away from the second bearing housing the engagement of the radial extension 40 with the cam element 41 causes the arm to pivot from its first position to its second position.

The threaded shaft 31 is formed with a threaded extension 42 having a finer thread than the threaded shaft and which threadably supports a cam member 43. The cam member 43 is associated with three switches 44, 45 and 46. The first switch 44 is fully engaged by the cam member when the arm is at its first position as shown at FIG. 9. The second switch 45 is fully engaged by the cam member when the arm is at its rearmost second position as shown at FIG. 11. The third switch is fully engaged by the cam member when the arm is at its rearmost and its forwardmost positions of the arm 13 when in the second position as shown at FIGS. 10 and 11.

The control means comprises a microprocessor which is able to; activate the drive motor 34 to cause movement of the arm 13; to activate the fan motors; activate the closures 22 and 23; and activate the pump which delivers water to the arm 13 in accordance with the required sequence of operation. The microprocessor uses the signals which are transmitted from the primary switch 38 and the first, second and third switches 44, 45 and 46 respectively to control the sequence of operation.

As stated previously the apparatus is associated with a main control switch (not shown) to initiate activation of the apparatus and which has a dual mode of activation depending upon whether the occupant is a male or female. On activation of the control switch the drive motor 34 is activated to cause the arm to move to its rearmost second position as shown at FIG. 11. As the arm approaches the rearmost location of its second position the first switch 44 is disengaged from the cam member 43 which causes the control means to deactivate the drive motor 34 to prevent further rearward movement, to activate the pump to deliver water from the nozzle of the arm 13 and to cause the drive motor to be activated to cause reciprocal movement of the arm through a small range of movement along the first axis at the rearmost position. After a predetermined period of time the pump is deactivated and the drive motor is activated to move the carrier forwardly. At its forwardmost location of the second position the second switch 45 is disengaged from the cam member 43 and at such a time if the control switch has been activated to indicate the presence of a female occupant the pump is reactivated and the drive motor is activated to cause the arm to reciprocate through a small range of movement at the forward locations. After a predetermined period of time the pump is deactivated and the drive motor 34 is activated to return the arm to its first position. In the event that the control switch has been activated to indicate the presence of a male occupant the carrier will be caused to return directly from the rearmost location of the second position directly to the first position. As the arm returns to its first position its radial extension 40 engages the activation arm 39 of the primary switch 38 to deactivate the drive motor 34. In addition the cam member 34 disengages from the third switch 46 to cause activation of the fan motors, control means will activate the fan for the rear duct and rear closure 22 if the control switch has been activated to indicate the presence of a male occupant and will activate both fans and both closures 22 and 23 if the control switch has been activated to indicate the presence of a female occupant.

A feature of each of the embodiments is that when the arm is at its first position it underlies the lip of the pedestal, on flushing of the toilet the arm and nozzle is rinsed by the water.

When it is necessary to lift the toilet seat the cam element 41 is caused to be moved out of engagement with the radial extension 40. As a result of spring biassing (not shown) which is provided on the arm 13, the radial extension 40 is caused to move such that the arm 13 will move from the first position to a position lying clear of the lip of the toilet bowl which then facilitates lifting of the toilet seat. The movement of the cam element 41 may be effected by means of a spring loaded member provided on the underneath of the toilet seat which is engaged on the toilet seat lying on the toilet bowl to bias the bearing element 40 into an engaging position with the radial extension 40. Alternatively any other form of suitable latching mechanism may be provided to effect movement of the bearing element 40.

It should be appreciated that the scope of the present invention need not be limited to the particular scope of the embodiment described above.

I claim:

1. A toilet seat adapted to be fixed to a toilet bowl to be movable between a seating position overlying the toilet bowl and a raised position, said seat accommodating a conduit adapted to be connected to a water supply, said conduit being connected to an outlet nozzle which is supported from an arm supported from the seat such that the nozzle is to be located within the toilet bowl and is directed upwardly, the arm being supported from the toilet seat to be movable to cause the nozzle to be movable along a path within the toilet bowl which is substantially coincidental with a fore and aft axis of the toilet bowl, the arm also being supported from the toilet seat to cause the nozzle to be movable from a first position adjacent a wall of the toilet bowl to a second position where the nozzle lies in the path, drive means to cause said movement of the arm, said seat accommodating an air duct adapted to be connected to a forced air supply, said air duct having an outlet at a front and rear of the toilet seat, said outlets being positioned to direct air to the posterior and anterior region of the occupant's body encompassed by the toilet seat, a control means controlling the delivery of water, the delivery of air and the operation of the drive means, said arm being movable on activation by the drive means from the first position to the second position, said arm being then moved to cause the nozzle to move along the path to at least one location at which location the arm is caused to move the nozzle through a small range of movement along the path at each location, the control means causing the delivery of water to the nozzle at said positions, the control means further causing the delivery of air to the duct subsequent to the delivery of water to the nozzle.

2. A toilet seat as claimed in claim 1 wherein the toilet seat is provided with a water reservoir and said conduit is connected to the water reservoir through a pump.

3. A toilet seat as claimed in claim 2 wherein the water reservoir is provided with a heater.

4. A toilet seat as claimed in claim 3 wherein the reservoir has a vertical dimension greater than its horizontal dimension.

5. A toilet seat as claimed in claim 4 wherein the water reservoir is connected to a mains water supply.

6. A toilet seat as claimed in claims 5 wherein the toilet seat accommodates the forced air supply.

7. A toilet seat as claimed in claim 6 wherein the first duct connects the first air supply to a first outlet provided at the rearmost portion of the inner rim of the toilet seat and a second duct connects the forced air supply to a second outlet provided at the forwardmost portion of the inner rim of the toilet seat.

8. A toilet seat as claimed in claim 7 wherein each outlet is associated with a closure operated from the control means to be opened on activation of the forced air supply.

9. A toilet seat as claimed in claim 8 wherein the forced air supply is provided with a heating means to heat air delivered to the ducts.

10. A toilet seat as claimed in claim 9 wherein the control means comprises a control switch to cause activation of the drive means whereby the arm may be capable of moving to one location only or may be capable of moving to two or more locations.

11. A toilet seat as claimed in claim 10 wherein the control means includes a sensing means to sense the presence of an occupant on the toilet seat, said control means being adapted to prevent activation of the drive means in the absence of an occupant.

12. A toilet seat as claimed in claim 11 wherein said arm underlies the upper lip of the toilet bowl when in its first position.

13. A toilet seat as claimed in claim 12 wherein the drive means is adapted to cause the arm to be moved from its first position prior to the toilet seat being moved from the seating position to the raised position.

14. A toilet seat as claimed in claim 13 wherein a heating means is provided in the toilet seat to heat the upper surface of the toilet seat.

* * * * *